US005810470A

United States Patent [19]

Garrant et al.

[11] Patent Number: 5,810,470

[45] **Date of Patent: *Sep. 22, 1998**

[54] DEVICE AND METHOD FOR MIXING MORTAR WITH A SPECIFIC RATIO OF SAND, CEMENT AND WATER

[75] Inventors: Jean Garrant, Pont-a-Mousson; Olivier Lalouette, Nancy; Jacques Thiery, Essey-les-Nancy, all of France

[73] Assignee: Pont-A-Mousson S.A., Nancy, France

[ * ] Notice: This patent issued on a continued prosecution application filed under 37 CFR 1.53(d), and is subject to the twenty year patent term provisions of 35 U.S.C. 154(a)(2).

[21] Appl. No.: 571,907

[22] PCT Filed: Jun. 7, 1994

[86] PCT No.: PCT/FR94/00829

§ 371 Date: Apr. 5, 1996

§ 102(e) Date: Apr. 5, 1996

[87] PCT Pub. No.: WO95/01830

PCT Pub. Date: Jan. 19, 1995

[30] Foreign Application Priority Data

Jul. 7, 1993 [FR] France ..... 93 08587

[51] Int. Cl.[6] ..... B01F 7/08; B28B 19/00; B28C 5/14

[52] U.S. Cl. ..... 366/8; 366/16; 366/50; 366/64; 366/320

[58] Field of Search ..... 366/64, 66, 152.1, 366/168.1, 169.1, 170.4, 171.1, 172.2, 186, 194–196, 320, 2, 6, 8, 16, 34, 50

[56] References Cited

U.S. PATENT DOCUMENTS

| | | | |
|---|---|---|---|
| 2,002,701 | 5/1935 | McWane et al. . | |
| 3,682,447 | 8/1972 | Zucker et al. | 366/172.2 X |
| 4,164,597 | 8/1979 | Smith | 366/186 X |
| 4,194,844 | 3/1980 | Walling | 366/320 X |
| 4,232,973 | 11/1980 | Ligouzat | 366/196 X |
| 4,492,478 | 1/1985 | Ito et al. | 366/196 X |
| 5,176,869 | 1/1993 | Okamoto et al. . | |

FOREIGN PATENT DOCUMENTS

| | | |
|---|---|---|
| 705338 | 6/1931 | France . |
| 2443277 | 7/1980 | France . |

OTHER PUBLICATIONS

Soviet Inventions Illustrated, Section Ch, Week 8732, 19 Aug. 1987, Derwent Publications Ltd., London, GB; Class J02, AN 87–227095 & SU,A,1 278 486 (Belo Water) see abstract.

*Primary Examiner*—Charles E. Cooley
*Attorney, Agent, or Firm*—Sughrue, Mion, Zinn, Macpeak & Seas, PLLC

[57] ABSTRACT

A mixing device (1) having at least two concentric tubular elements (2, 3) including an outer tubular element (2) and an inner tubular element (3) inside the outer tubular element, the outer tubular element and the inner tubular element each supplying a liquid (5) or solid products to be mixed together, and a helical member (4) disposed for rotational movement inside the outer tubular element for entrainment of the liquid (5) or solid products, the helical member surrounding the inner tubular element, the outer tubular element including at least one inlet orifice (6*a*) for introducing the liquid (5) or solid products into the outer tubular element to be entrained by the helical member, and an outlet orifice (7) for delivering a mixture (9) of the liquid and solid products (5, 8) outside the outer tubular element, the inner tubular element (3) having an open end terminating inside the outer tubular element (2) downstream of the inlet orifice (6*a*) and upstream of the outlet orifice (7), wherein the mixture (9) is mortar, and the mortar is made of sand S, cement C and water W in ratios S/C from 0 to 10 and W/C from 0.1 to 2.

9 Claims, 1 Drawing Sheet

DEVICE AND METHOD FOR MIXING MORTAR WITH A SPECIFIC RATIO OF SAND, CEMENT AND WATER

BACKGROUND OF THE INVENTION

1. Field of the Invention

The present invention relates to the mixing of a hydraulic binder and of mineral materials with a liquid. It relates firstly to a use of a device comprising at least two concentric tubular elements, the outer tubular element containing a helical means for entrainment of liquids or solid products in the divided state.

More particularly, it relates to a device comprising at least two concentric tubular elements, the outer tubular element containing a helical means for entrainment of liquids or solid products in the divided state, for example in the form of grains and/or in the powdered state, the said helical means surrounding the inner tubular element, the outer tubular element comprising at least one inlet orifice for the liquid or solids and one outlet orifice for the mixture of liquid and solids, the said inner tubular element emerging inside the outer tubular element downstream of the inlet orifice and upstream of the outlet orifice.

2. Background Art

Such known devices (see, for example, patents FR-A-1, 436,336 in the name of M. RASTOIN and FR-A-2,414,952 in the name of M. LIGOUZAT) are used for mixing and transporting solid products and liquids for the purpose of a subsequent operation. Nowhere in these documents is there specified a means for setting these elements so as to form a new composition, nor is provision made for dispensing the mixed products.

SUMMARY OF THE INVENTION

The object of the invention is to overcome these drawbacks. To this end, the device which is defined hereinabove is used to obtain a composition based on at least one hydraulic binder by semi-continuous mixing of the hydraulic binder with a liquid.

According to other characteristics, the device is used for:

mixing, transporting and dispensing a composition based on a hydraulic binder, on mineral materials, and on liquid;

dispensing and distributing a composition;

lining a pipe;

manufacturing a pipe.

The subject of the invention is also an installation which allows a use such as defined hereinabove.

The said installation includes a device in accordance to the one described hereinabove and it further includes a moving carriage supporting the said device including metering supply members in the upstream part of the device and a device for controlling and synchronizing the displacement of the carriage as a function of the supply.

This installation allows the hydraulic binder to be supplied and dispensed.

According to other characteristics it comprises a rotary axisymmetric element open at one end, the said rotary element being concentric with and of a greater diameter than the tubular elements of the device.

A further subject of the invention is a method for lining a metal pipe based on quick-setting cement.

According to another characteristic, the lining is based on mortar containing a significant proportion of sand.

BRIEF DESCRIPTION OF THE DRAWING FIGURE

A non-limiting example of the invention will now be described with reference to the appended drawing, the single FIGURE of which diagrammatically represents an installation for mixing and dispensing a hydraulic binder in accordance with the invention.

DETAILED DESCRIPTION OF THE PREFERRED EMBODIMENTS

Figure 1:
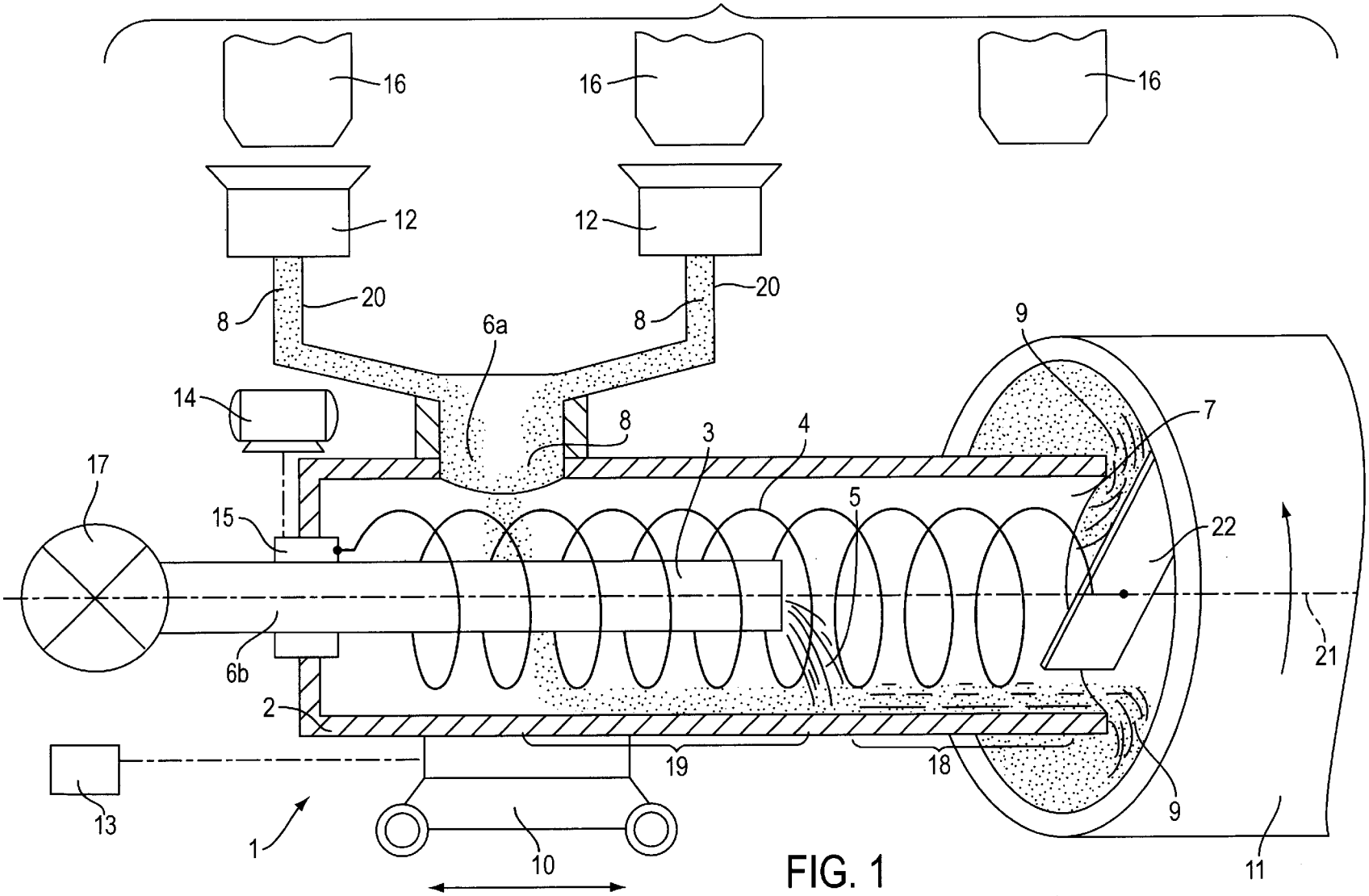

The installation represented in the drawing comprises a device 1 formed of a tubular element 2 concentrically surrounding a second, emerging, tubular element 3. A helical spring 4 contained in the first tubular element 2 surrounds the second tubular element 3 for conveying water 5. The first tubular element 2 exhibits, on the upper part of its circular envelope, an inlet orifice 6*a* and at one end exhibits an inlet orifice 6*b*, its other, open, end forms an outlet orifice 7. The tubular element 3 passes through the orifice 6*b*. Dry materials 8 made up particularly of minerals, for example sand and a hydraulic binder such as a cement are conveyed via the orifice 6*a*. The mixing of the dry materials 8 with water 5 forms a mortar 9 which leaves via the orifice 7.

The device 1 is placed on a carriage 10.

A rotary pipe 11 of an inside diameter greater than the outside diameter of the first tubular element is located level with the open end of the first tubular element 2, forming a dispensing injection tube.

The pipe 11 is concentric with the tubular element 2 forming a dispensing injection tube. Metering members 12 are connected to the upper inlet orifice 6*a*. A control and synchronization device 13 makes it possible to adjust the movements of the installation which comprises a motor 14 for setting into motion hollow rotary bearings 15 for entraining the spring 4. Hoppers 16 containing either cement, or various minerals such as sand, are located above the metering members 12. A pump 17 connected to the tubular element 3 makes it possible to supply the device 1 with water.

The tubular element 3 emerges into the tubular element 2 downstream of the inlet orifice 6 and upstream of the outlet orifice 7 so as to form, downstream of the outlet from the element 3 a location 18 for mixing dry materials with water and upstream a zone 19 for transporting and mixing the dry materials 8. The metering members 12 are connected fixedly to the carriage 10 by the device 1 and rigid pipelines 20 for conveying the dry materials. A deflector 22 is placed at the end of the spring 4.

The installation dispenses mortar 9 into the pipe 11 by means of the dispensing injection tube 2.

This operation is carried out while simultaneously ensuring the rotation of the pipe 11 on its axis 21, the translation of the device 1, and the mixing, transportating into the injection tube 2 and dispensing.

The helical spring 4 placed inside the injection tube 2 is given a fast rotational movement. The dry materials 8 are introduced with controlled flow rates into the zone 19 of the injection tube 2. The spring 4, rotating rapidly, immediately provides vigorous stirring which allows perfect mixing of the various dry materials 8, as well as transportation of these materials in the injection tube 2 towards the location 18.

The water 5 is injected by means of a second tubular element 3 into the location 18 of the feed injection tube 2. There again, the fast rotational movement of the spring 4 ensures perfect mixing of the dry materials 8 with the water 5 as well as the transportation of the mortar 9, thus finished, towards the outlet orifice 7 of the injection tube 2.

At the same time as these mixing operations, the rotational movement of the pipe and the translational movement of the injection tube ensure immediate dispensing of the mortar into the pipe 11 as it leaves the dispensing injection tube 2. The deflector 22 allows even spraying of the mortar 9 in order to form a uniform lining of the pipe 11.

A system is therefore available for continuous mixing/transportating/dispensing because the mortar 9 is installed inside the pipe 11 as it is prepared.

This installation exhibits the advantage of being able to limit the quantity of moist mortar 9 present at each instant in the installation with a location 18 of small size.

Therefore the amount of time that this mortar 9 spends in the device 1 is small.

What is more, in the event of an instantaneous halting of the device 1, only the location 18 needs to be cleaned out, the rest of the device 1 containing only dry materials.

This installation allows the use of very quick-setting cements. The minimum setting time for this cement can be as little as 3 minutes. It is thus possible to use mortars exhibiting a great variation in rheology.

The rheology of the mortar 9 varies depending on the difference in the amount of some of the components with respect to each other. Thus, in a composition 9 comprising water 5, cement and sand, if there is little water 5, the mortar 9 will be very dry, if there is a lot of water 5 the composition decants, the solid materials (sand, cement) 8 will fall to the bottom and the water 5 will rise back up to the surface. It is possible, in this installation, to mix and to dispense mortars comprising no sand up to ten times more sand than cement, that is a ratio S/C from 0 to 10, S being the sand and C the cement. These mortars also lie within a ratio W/C from 0.1 to 2. W being the water 5 and C the cement.

The installation makes it possible to avoid the mortar 9 decanting because it does not produce any pressure and stirs the said mortar.

This installation makes it possible, for example, to dispense very dry mortars, mortars containing a significant proportion of sand, and mortars which have a high tendency to segregate.

We claim:

1. A system including a mixing device (1) and a mortar mixed by the mixing device, said system comprising:

at least two concentric tubular elements (2, 3) including an outer tubular element (2) and an inner tubular element (3) inside said outer tubular element, said outer tubular element and said inner tubular element each supplying one of a liquid (5) and solid products to be mixed together; and a helical member (4) disposed for rotational movement inside said outer tubular element for entrainment of the liquid (5) or solid products, said helical member surrounding said inner tubular element, said outer tubular element comprising at least one inlet orifice **(6*a*) for introducing the liquid (5) or solid products into said outer tubular element to be entrained by said helical member, and an outlet orifice (7) for delivering a mixture (9) of the liquid and solid products (5, 8) outside said outer tubular element, said inner tubular element (3) having an open end terminating inside said outer tubular element (2) downstream of said inlet orifice (6*a*) and upstream of said outlet orifice (7), wherein said mixture (9)** is mortar, and said mortar comprises water W, sand S and cement C as the liquid and solid products, in ratios S/C from 0 to 10 and W/C from 0.1 to 2.

2. A system as recited in claim 1, wherein said outlet orifice (7) of said outer tubular element (2) fits inside a pipe (11) for coating an inner surface of said pipe (11) with said mortar.

3. A system as recited in claim 1, further comprising a moving carriage (10) supporting said outer tubular element (2), and metering supply members (12) in fluid communication with said at least one inlet orifice **(6*a*) of said outer tubular element (2), and further comprising a device (13) for controlling and synchronizing displacement of said moving carriage (10)** in accordance with a supply of said solid products.

4. A system as recited in claim 1, wherein the cement C is a quick-setting cement.

5. A method for mixing mortar in a mixing device having concentric inner and outer tubular elements, a rotatably mounted helical member in an annular region between the inner and outer tubular elements, the outer tubular element having an inlet orifice and an outlet orifice, and the inner tubular element having an open end terminating inside the outer tubular element downstream of the inlet orifice and upstream of the outlet orifice, said method comprising:

supplying one of a solid component of the mortar and a liquid component of the mortar through the inlet orifice into the outer tubular element;

supplying the other one of the solid and liquid components of the mortar through the inner tubular element;

rotating the helical member to mix the solid and liquid components in a region of the outer tubular element between the open end of the inner tubular element and the outlet orifice of the outer tubular element to form the mortar, and to transport the mortar toward the outlet orifice of the outer tubular element, wherein the solid and liquid components of the mortar comprise sand S, cement C and water W in ratios S/C from 0 to 10 and W/C from 0.1 to 2.

6. A method as recited in claim 5, wherein the mixing device includes a mobile carriage that supports the outer tubular element, said method further comprising the step of:

moving the mobile carriage relative to an object to be coated with the mortar.

7. A method as recited in claim 6, wherein the object to be coated is a pipe, and said moving step comprises:

inserting the outlet orifice of the outer tubular element to a position inside the pipe for coating an inner surface of the pipe with the mortar.

8. A method as recited in claim 7, wherein the pipe is rotated while the outer tubular element is held stationary.

9. A method as recited in claim 6, wherein movement of the mobile carriage is determined in accordance with a flow rate of the solid component of the mortar.

* * * * *